US009296501B2

(12) United States Patent
Haberstroh et al.

(10) Patent No.: US 9,296,501 B2
(45) Date of Patent: Mar. 29, 2016

(54) MODULAR STRAP FEEDER WITH MOTOR FOR INDEXING AND GRIPPING

(75) Inventors: James A. Haberstroh, Vernon Hills, IL (US); Allan J. Bobren, Streamwood, IL (US); Roy J. Jensen, Pleasant Prairie, WI (US)

(73) Assignee: Signode Industrial Group LLC, Glenview, IL (US)

( * ) Notice: Subject to any disclaimer, the term of this patent is extended or adjusted under 35 U.S.C. 154(b) by 531 days.

(21) Appl. No.: 13/099,876

(22) Filed: May 3, 2011

(65) Prior Publication Data

US 2012/0017780 A1 Jan. 26, 2012

Related U.S. Application Data

(60) Provisional application No. 61/366,659, filed on Jul. 22, 2010.

(51) Int. Cl.

| | |
|---|---|
| ***B65B 27/12*** | (2006.01) |
| *B65B 13/22* | (2006.01) |
| *B65B 13/02* | (2006.01) |

(52) U.S. Cl.

CPC ..... *B65B 27/12* (2013.01); *B65B 13/02* (2013.01); *B65B 13/22* (2013.01)

(58) Field of Classification Search

CPC ..... B65B 13/22; B65B 13/02; B65B 27/12
USPC ..... 100/26, 29, 32; 53/589; 56/341
See application file for complete search history.

(56) References Cited

U.S. PATENT DOCUMENTS

| | | | | |
|---|---|---|---|---|
| 4,011,807 | A * | 3/1977 | Kobiella | 100/2 |
| 4,378,262 | A * | 3/1983 | Annis, Jr. | 156/73.5 |
| 4,952,270 | A * | 8/1990 | Sakaki et al. | 156/361 |
| 5,287,802 | A * | 2/1994 | Pearson | 100/4 |
| 5,377,477 | A * | 1/1995 | Haberstroh et al. | 53/399 |
| 5,459,977 | A * | 10/1995 | Haberstroh | 53/399 |
| 6,053,387 | A * | 4/2000 | Garbotz et al. | 226/49 |
| 6,463,848 | B1 * | 10/2002 | Haberstroh et al. | 100/32 |
| 6,568,158 | B2 * | 5/2003 | Shibazaki et al. | 53/582 |
| 7,165,379 | B1 * | 1/2007 | Lai | 53/589 |
| 7,389,723 | B1 | 6/2008 | Bullington | |
| 7,421,944 | B1 | 9/2008 | Flaum et al. | |
| 7,770,369 | B2 | 8/2010 | Doyle | |
| 2004/0200191 | A1 | 10/2004 | Armstrong | |

* cited by examiner

*Primary Examiner* — Alexander P Taousakis
*Assistant Examiner* — Leonel Vasquez
(74) *Attorney, Agent, or Firm* — Levenfeld Pearlstein, LLC

(57) ABSTRACT

A strap feed assembly for a strapping machine reduces wear on the pinch and drive wheels of feed head components by creating a gap between the pinch and drive wheels while using a cam and an engagement surface to grip the strap during a cut-and-seal phase of a strapping cycle. In the strap feed assembly, a rocker arm has an engagement surface and a pivot axis parallel to both the axis of rotation of the pinch wheel and the axis of rotation of the drive wheel. An eccentric cam, driven by a cam motor, is engageable with the engagement surface of the rocker to move the pinch wheel into and out of engagement with the drive wheel. Thus, the pinch and drive wheels are configured to grip the strap during a strap feed phase, while the cam and the engagement surface grip the strap during the cut-and-seal phase.

20 Claims, 12 Drawing Sheets

MODULAR STRAP FEEDER WITH MOTOR FOR INDEXING AND GRIPPING

CROSS REFERENCE TO RELATED APPLICATIONS

This application claims the benefit of U.S. Provisional Application No. 61/366,659, filed Jul. 22, 2010.

FIELD OF THE DISCLOSURE

The present disclosure is directed to a strap feeder for use with strapping machines and, more particularly, to a modular strap feeder configured to reduce wear of feed head components and can be used for strapping compressed loads.

BACKGROUND

Strapping machines are well known in the art for securing straps, such as plastic strapping material, around loads. In one configuration, a strapping machine is used to strap compressed loads, such as baled cotton or other textile materials. One such strapping machine is disclosed in commonly assigned patent to Flaum U.S. Pat. No. 7,421,944, which is incorporated herein by reference. Often the loads are large, such that in a typical arrangement, multiple straps are fed, tensioned, and sealed around the load to secure the entire load.

One typical strapping machine includes several separate, but interdependent modular feed and strapping units, each of which includes, among other things, a feed head having a pinch wheel and a drive wheel. A dispenser feeds strap from a strap supply to the feed head. In many configurations, the dispenser is configured to bias the strap directly away from the feed head and toward the dispenser, such as through spring-lock mechanisms as are known in the art.

The strap is directed between the pinch and drive wheel prior to entering a strap chute to encircle the load. The end of the strap is gripped and held between the pinch and drive wheels during the strap feed process. The trailing end of the strap remains gripped between the pinch and drive wheels until the strap is indexed for the next load. Each individual strapping unit operates in a similar manner in conjunction with each other unit so that the strapping occurs simultaneously at each of the several units. In this manner, the strapping operation is carried out in an efficient and time effective operational mode.

While the strap is gripped between the pinch wheel and the drive wheel as it is being fed, a dispenser wheel exerts a retractile force on the strap. Over time, this retractile force can cause the drive and pinch wheels to be pulled out of alignment with each other and mounting elements of each wheel to become loosened or skewed. In addition, the strap can become dislodged from between the wheels. Furthermore, because all the drive wheels in a multi-feed unit strapping machine are typically driven on a common drive shaft of a single motor, if one of the modular feed units requires servicing, all of the modular feed units must be taken out of operation in order to service the unit(s) in need of servicing.

In another type of strapping machine, a strap seal that has been formed is rotated around the load to a more convenient location. In the present example, the motor used to rotate the strap seal around the load, however, is the same motor that drives the drive wheel to feed the strap. Thus, unless the drive wheel is decoupled from the strap, when the motor operates to rotate the strap seal around the load, the motor also feeds excess strap through the strapping machine. Common fixes to this issue have been to add mechanical or electromechanical clutches or other stabilizing mechanisms around the pinch and drive wheels. These mechanisms, however, can be complex, bulky, and heavy, not in keeping with the modular design of the feed unit. In addition, the pinch and drive wheels are still acted upon by forces that could move the wheels out of alignment with each other and cause wear and tear on the pinch and drive wheels themselves.

Accordingly, it would be desirable to have a strap feeder assembly configured to grip and index the strap that prevents or decreases the wear and tear on the pinch and drive wheels of the strap feed head and enables the user to isolate and service one unit without disturbing the remaining units in the assembly. Desirably, such an assembly is in keeping with the modular design of the feed head and is not overly complex, bulky, or heavy. More desirably, such an assembly increases the useful life of the components of the strap feed heads.

BRIEF SUMMARY

Various embodiments of the present disclosure provide a modular strap feeder assembly for use with a strapping machine of the type for feeding a strapping material around a load, tensioning the strapping material, and sealing the strapping material onto itself in a loop around the load. The modular strap feeder assembly includes a frame and a drive wheel mounted to the frame and having a first axis of rotation. The drive wheel is configured to be connected to a first drive for rotating the drive wheel. The strap feeder assembly also includes a pinch wheel having a second axis of rotation parallel to and spaced from the first axis of rotation of the drive wheel and a rocker arm mounted to the frame in communication with the pinch wheel and including an engagement surface and a pivot axis parallel to both the first and second axes of rotation. Further, an eccentric cam is coupled to the frame and a cam motor is coupled to the eccentric cam. The eccentric cam, driven by the cam motor, is engageable with the engagement surface of the rocker arm to move the pinch wheel into and out of engagement with the drive wheel.

Still other embodiments of the present disclosure provide a first or strap feed position, wherein the pinch wheel and the drive wheel are engaged with each other to feed strap through the strap chute and the eccentric cam is disengaged from the rocker arm. When the desired length of strap is fed through the strap chute, the pinch wheel is moveable away and disengageable from the drive wheel, by action of the eccentric cam on the engagement surface of the rocker.

In other examples of the present disclosure, the eccentric cam is driven by the cam motor and is engageable with an engagement surface of the rocker arm causing the rocker arm to rotate. The rocker arm pivots or rotates about a pivot axis, in one example, in a clock-wise direction. Rotation of the rocker arm by the eccentric cam forces one or more rollers to engage with a peak of a handle which in turn tilts or pivots the pinch wheel. Movement of the rocker in turn moves the pinch wheel, mounted to the rocker, out of the plane of the strap, forming a larger gap between the pinch wheel and the drive wheel. Simultaneously, the eccentric cam grips the strap between the cam and the engagement surface. Thus, rotation of the eccentric cam enables both engagement of the cam with the engagement surface of the rocker arm and disengagement of the pinch wheel from the drive wheel, such that the strap is no longer pinched between the pinch wheel and the drive wheel and is instead secured between the eccentric cam and the engagement surface of the rocker. This is a second, or cut-and-seal position.

When the strap is gripped between the eccentric cam and the engagement surface of the rocker, the strap can be cut by a strap sealing head of the strapping machine. The retractile force of the dispenser on the pinch and drive wheels is reduced as the strap is instead gripped between the cam and the engagement surface, rather than between the pinch and drive wheels. As the cam continues to rotate, the strap is indexed such that the strap is made ready for another load. The pinch wheel is moved into engagement with the drive wheel once again while the cam is released. The next load may then be strapped.

A proximity sensor may be included to control the position of the eccentric cam and convey positional/status information regarding the eccentric cam to a strapping machine controller, which in turn signals the cam motor to move the cam into and out of engagement with the rocker arm. Thus, the action of the eccentric cam on the strap, in either the strap feed position or the strap hold/pinch position, may be controlled by the proximity sensor in conjunction with the strapping machine controller.

A strapping machine having multiple strapping units with the modular feeder is also disclosed.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
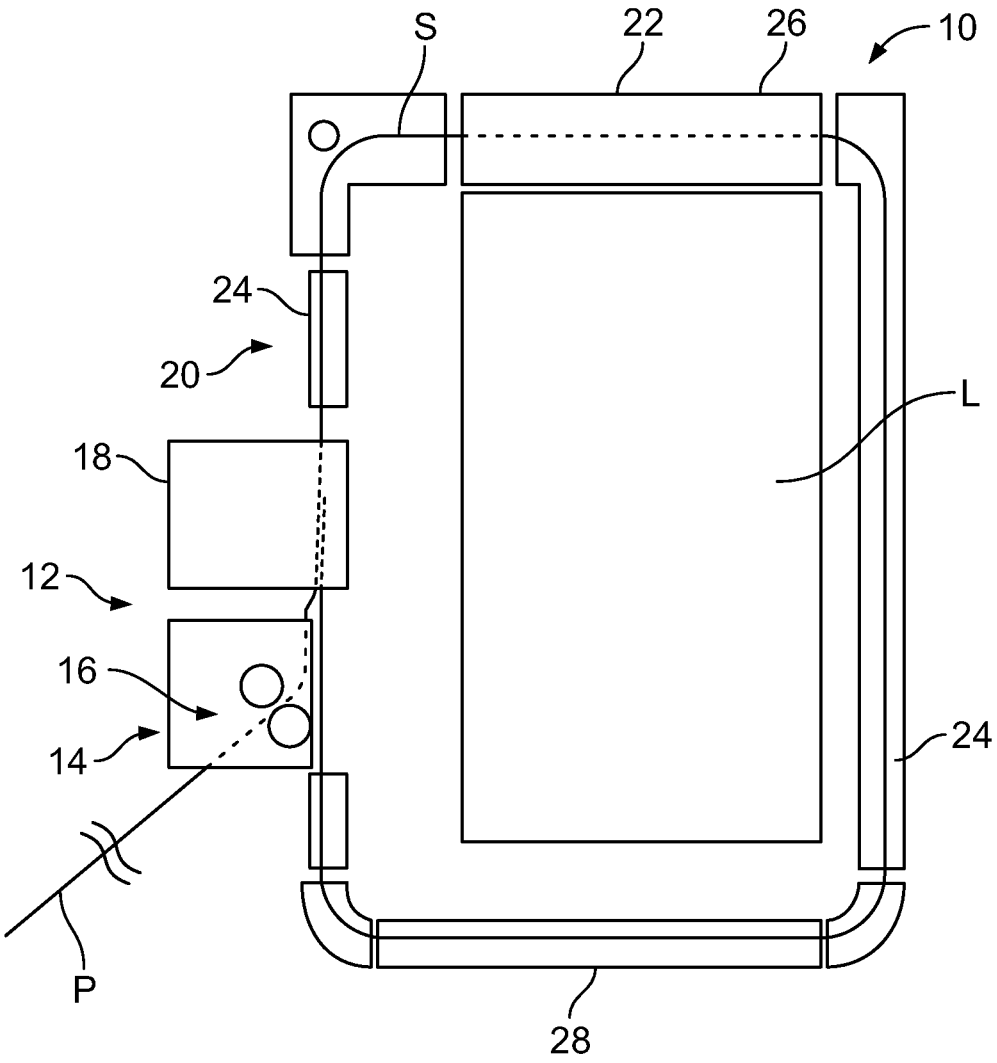
FIG. 1 is a schematic block diagram of a strapping machine in accordance with an embodiment of the present disclosure.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated. The words "a" or "an" are to be taken to include both the singular and the plural. Conversely, any reference to plural items shall, where appropriate, include the singular.

Figure 2:
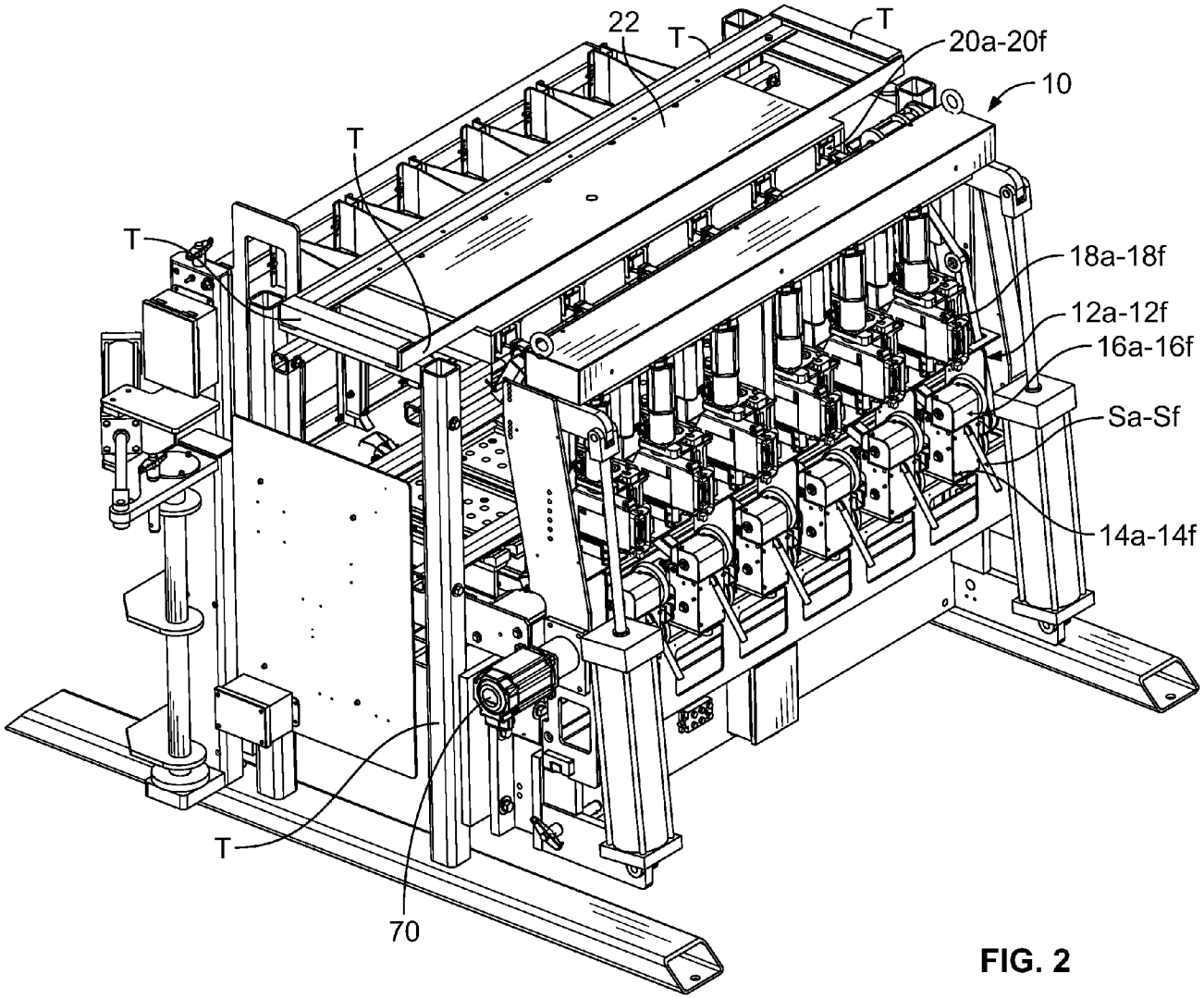
FIG. 2 is an isometric view of a strapping machine that includes a modular strap feeder assembly in accordance with another embodiment of the present disclosure.
Figure 3:
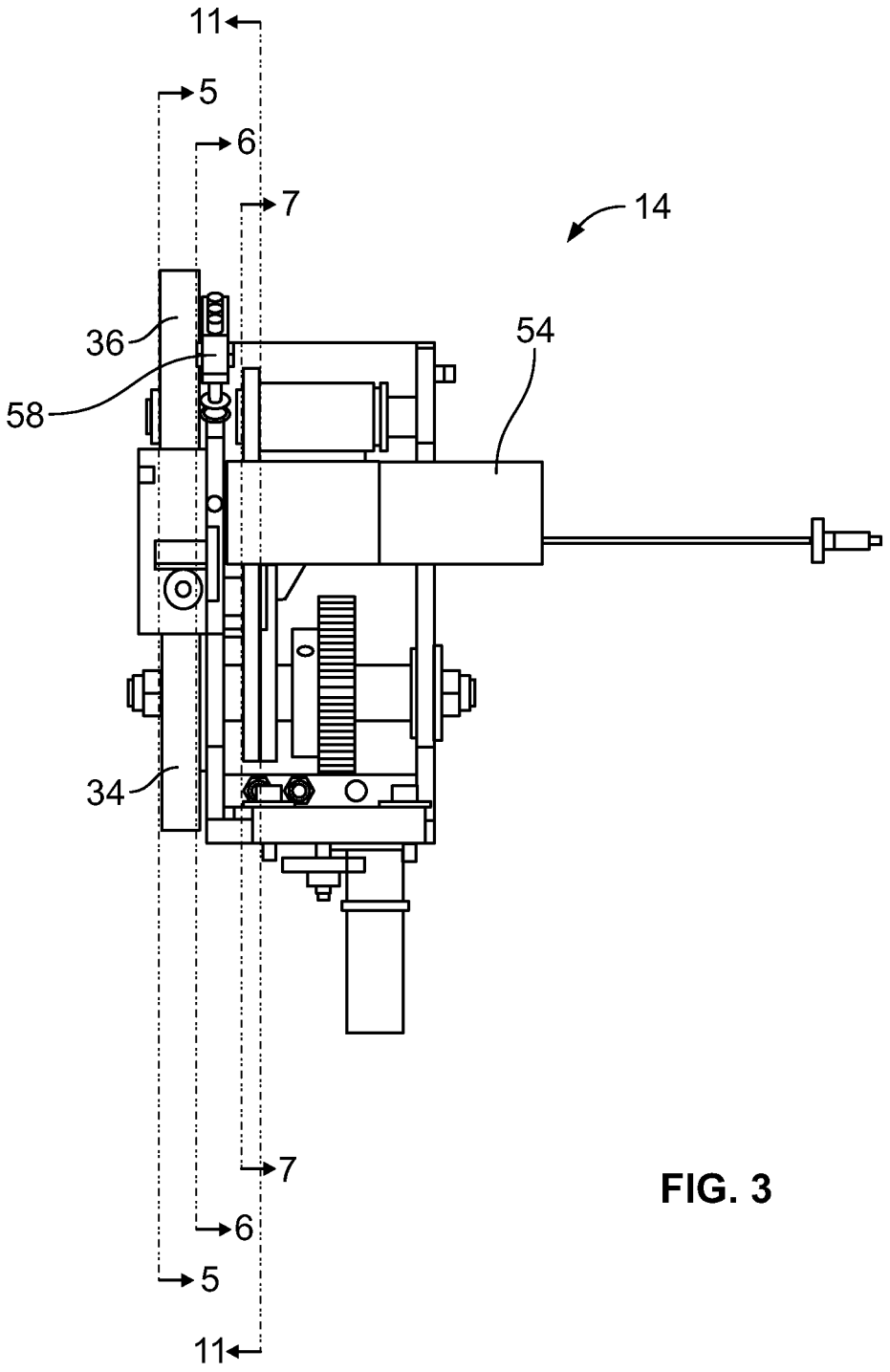
FIG. 3 is a front elevational view an example of a modular strap feeder assembly.
Figure 4:
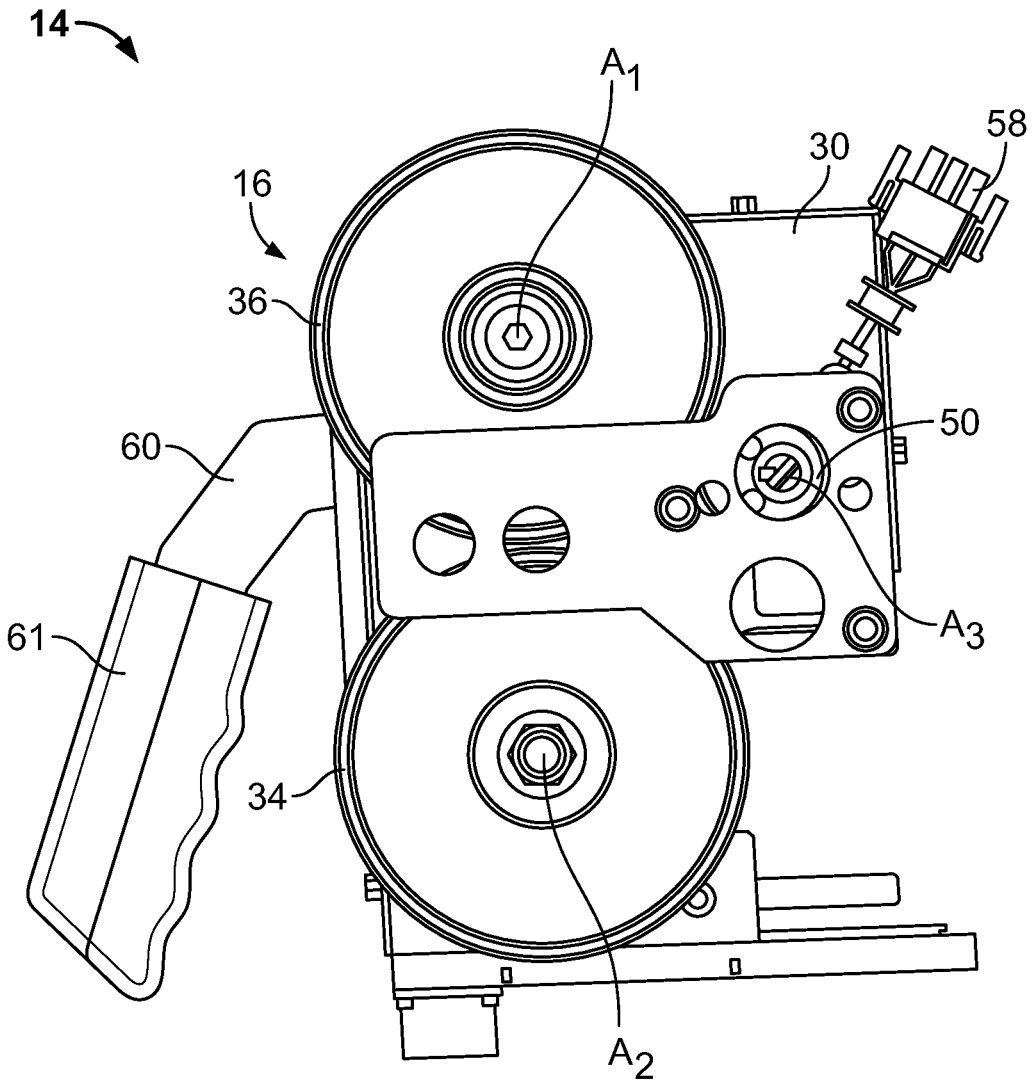
FIG. 4 is a right-side elevational view of the modular strap feeder assembly of FIG. 3.

Referring to the figures and in particular to FIGS. 1 and 2, a strapping machine 10 in accordance with an embodiment of the present disclosure includes one or more strapping units 12*a*-12*f* associated therewith. In the present example, each strapping unit 12 includes a strap feed assembly 14 with a feed head 16 to feed strap material S from a strap supply P. Each illustrated strapping unit 12 also includes a sealing head 18 and a strap chute 20. In the strapping machine 10 of FIG. 2, there are six separate but interdependent strapping units 12*a*-12*f*, with associated feed assemblies 14*a*-14*f*, feed heads 16*a*-16*f*, strap material Sa-Sf, sealing heads 18*a*-18*f*, and strap chutes 20*a*-20*f*, respectively. However, those skilled in the art will appreciate that the strapping machine 10 may have additional or fewer strapping units 12 and associated components without departing from the spirit and scope of the present disclosure.

FIGS. 1 and 2 also illustrate an upper compression plate or platen 22 that compresses a load L to be secured with the strap material S. Referring more particularly to FIG. 1, the strap chute 20 includes side portions 24, an upper portion 26, and a lower portion 28. In the present example, the upper platen 22 includes the upper portion 26 of the strap chute 20. It should be noted that the strapping machine 10 shown in FIG. 2 is illustrated with a test frame T to accommodate testing of the strapping machine 10 and that such test frame is not typically part of the machine during normal operation. Additional details of strapping machines are disclosed in Bullington U.S. Pat. No. 7,389,723 and Flaum et al. U.S. Pat. No. 7,421,944, each of which is incorporated by reference herein in its entirety.

Figure 6:
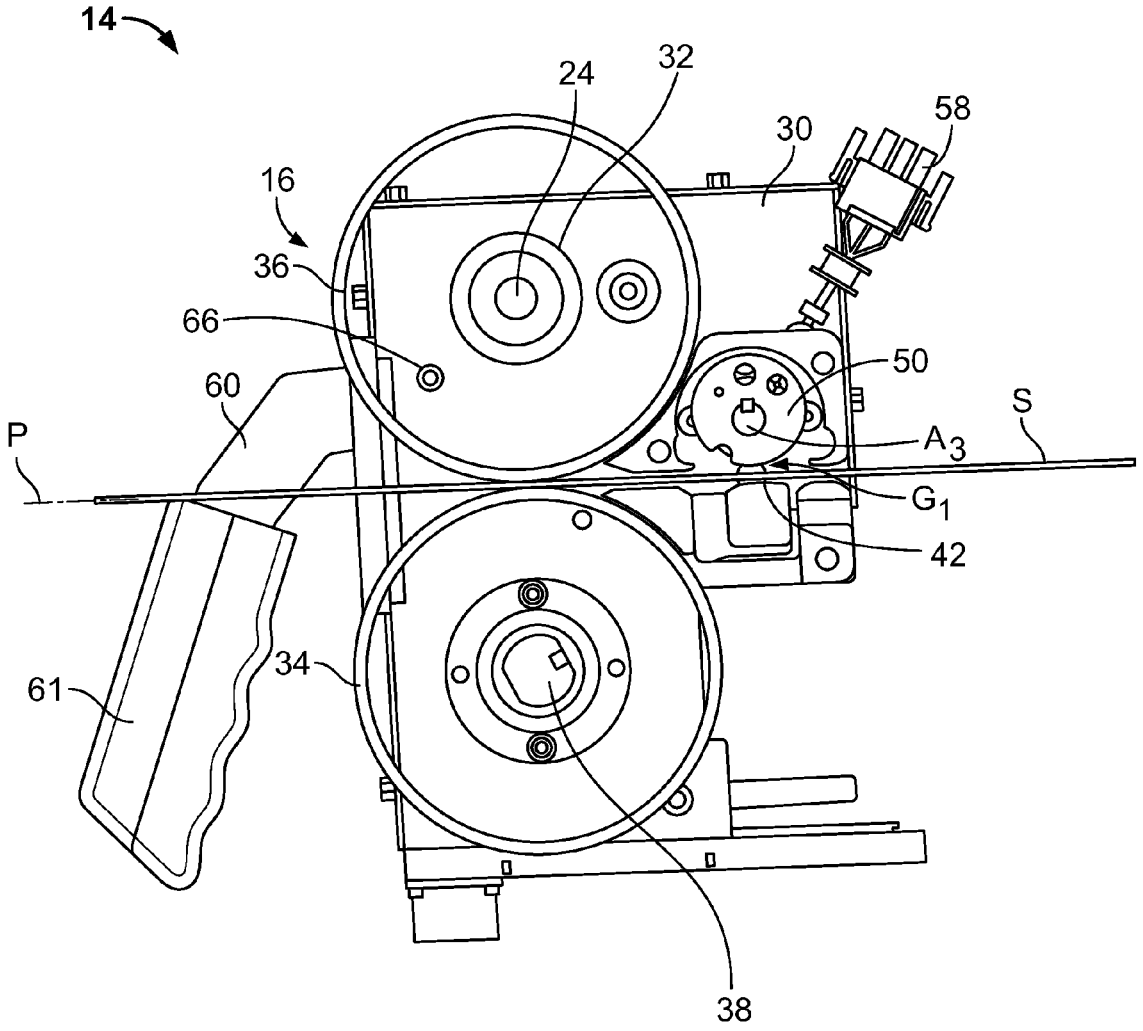
FIG. 6 is a cross-sectional view of the modular strap feeder assembly of FIG. 3 in a strap feed position, taken generally along lines 6-6 of FIG. 3.
Figure 7:
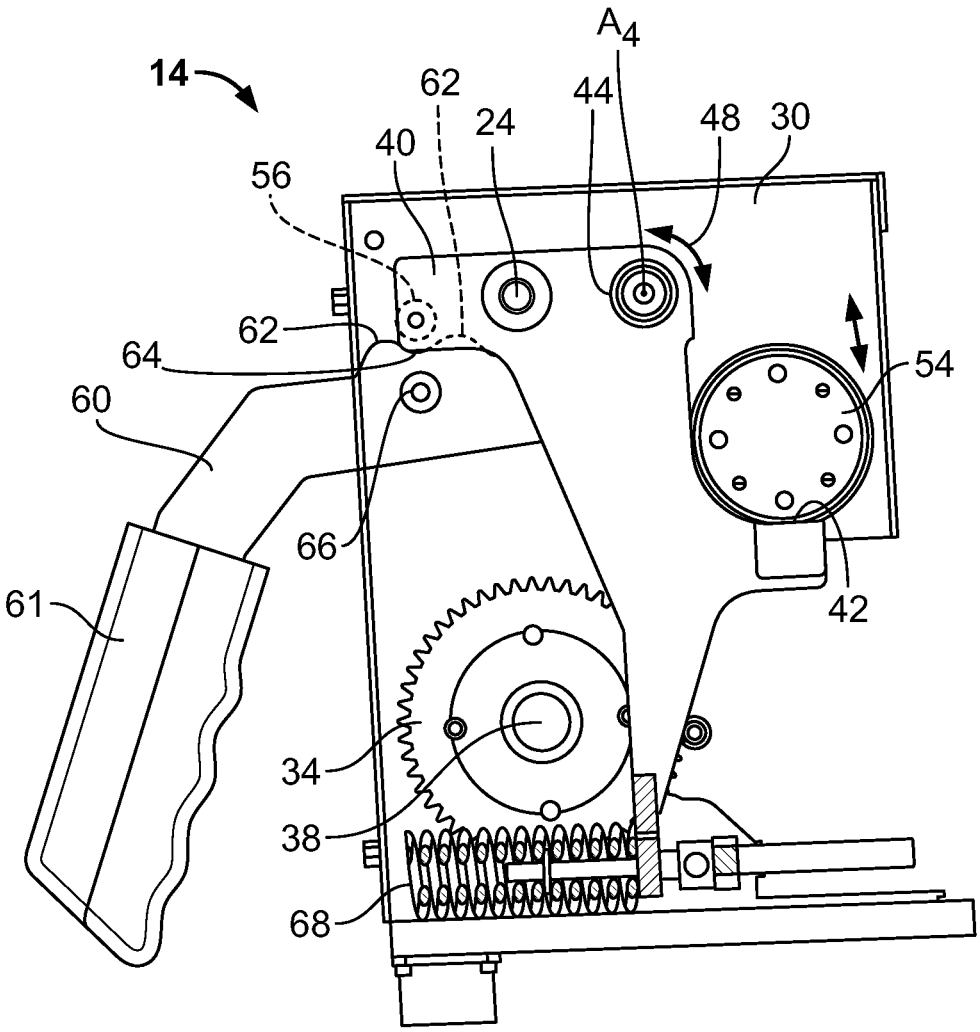
FIG. 7 is a cross-sectional view of the modular strap feeder assembly of FIG. 3 in a strap feed position, taken generally along lines 7-7 of FIG. 3
Figure 8:
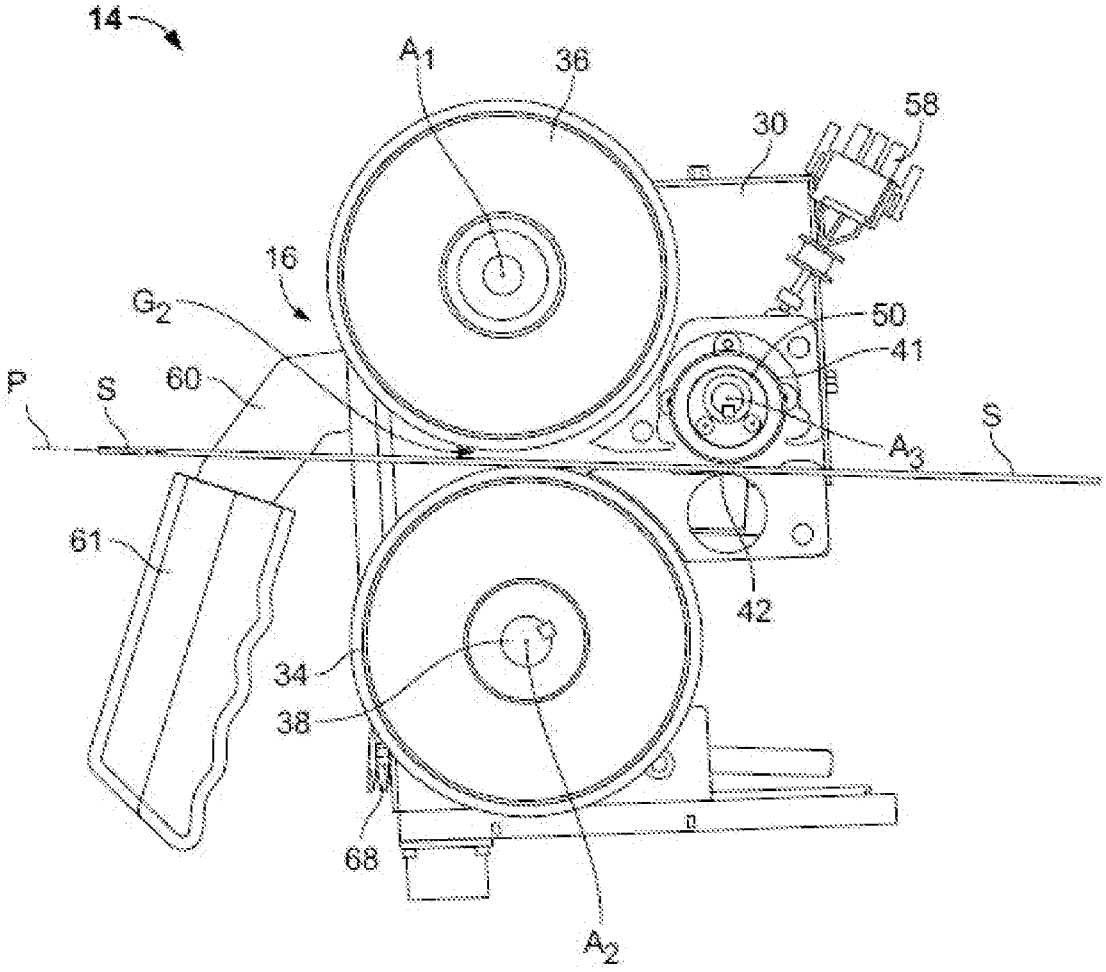
FIG. 8 is a cross-sectional view similar to FIG. 5 of the modular strap feeder assembly in a strap grip or cut-and-seal position.
Figure 9:
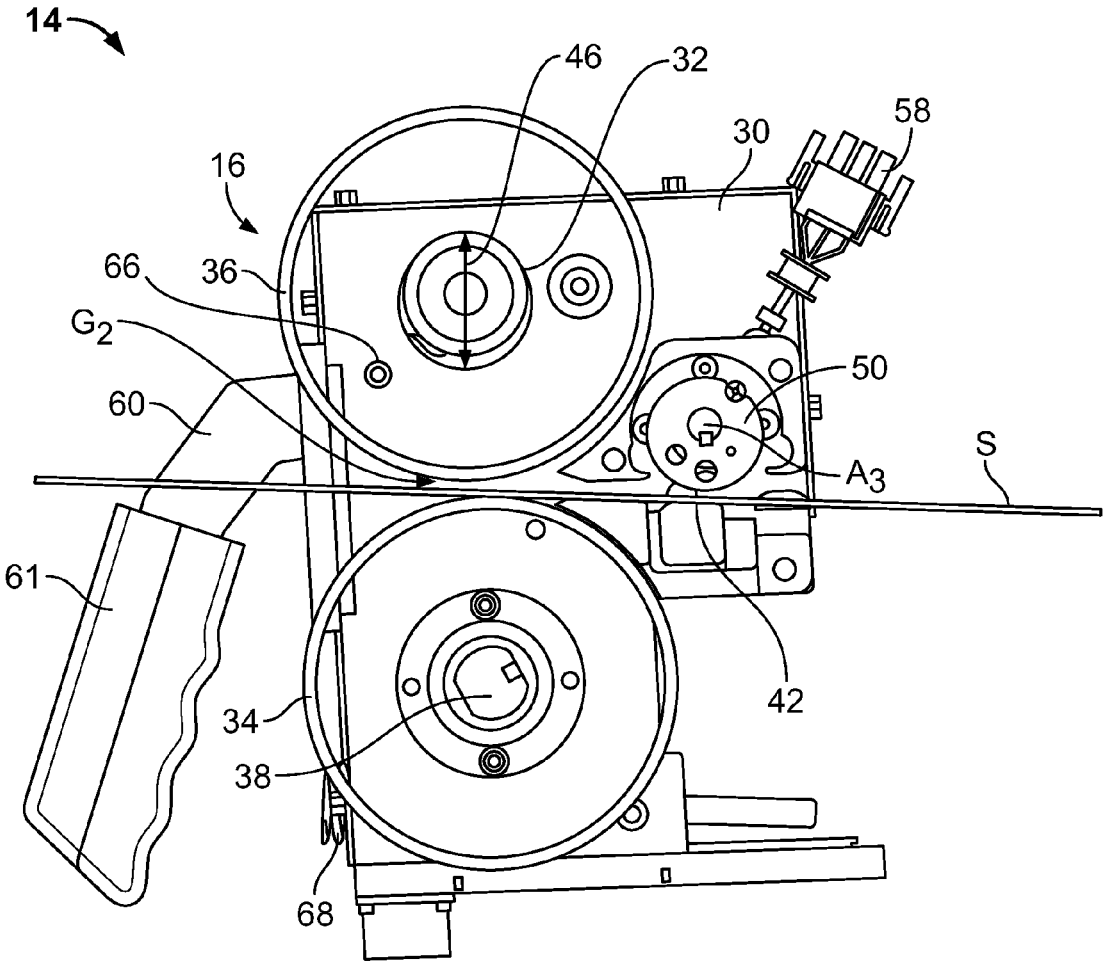
FIG. 9 is a cross-sectional view similar to FIG. 6 of the modular strap feeder assembly in a strap grip or cut-and-seal position.

Turning now to FIGS. 3-12, the modular feed assembly 14 includes a frame 30 with the feed head 16, a rocker arm 40 (shown more clearly in FIG. 7, for example), and an eccentric cam 50 coupled to the frame. The feed head 16 further includes a drive wheel 34 and a pinch wheel 36. The drive wheel 34 has an axis of rotation $A_2$ while the pinch wheel 36 has an axis of rotation $A_1$. In the present example, the axis of rotation $A_1$ is generally parallel to the axis of rotation $A_2$. The drive wheel 34 and the pinch wheel 36 may have complementary convex and concave profiles or perimeters. A gap $G_2$ is defined between adjacent surfaces of the drive wheel 34 and the pinch wheel 36, as seen in FIGS. 8 and 9, for example. The drive wheel 34 is operably connected to the frame 22 by a drive shaft 38 of a motor, such as a motor 70 of the strapping machine 10 of FIG. 2. Each of the drive wheels 34 of the feed heads 14*a*-14*f* may be coupled to the same drive shaft of a single motor or to different drives shafts coupled to one or more motors, as would be apparent to one of ordinary skill in the art.

Figure 5:
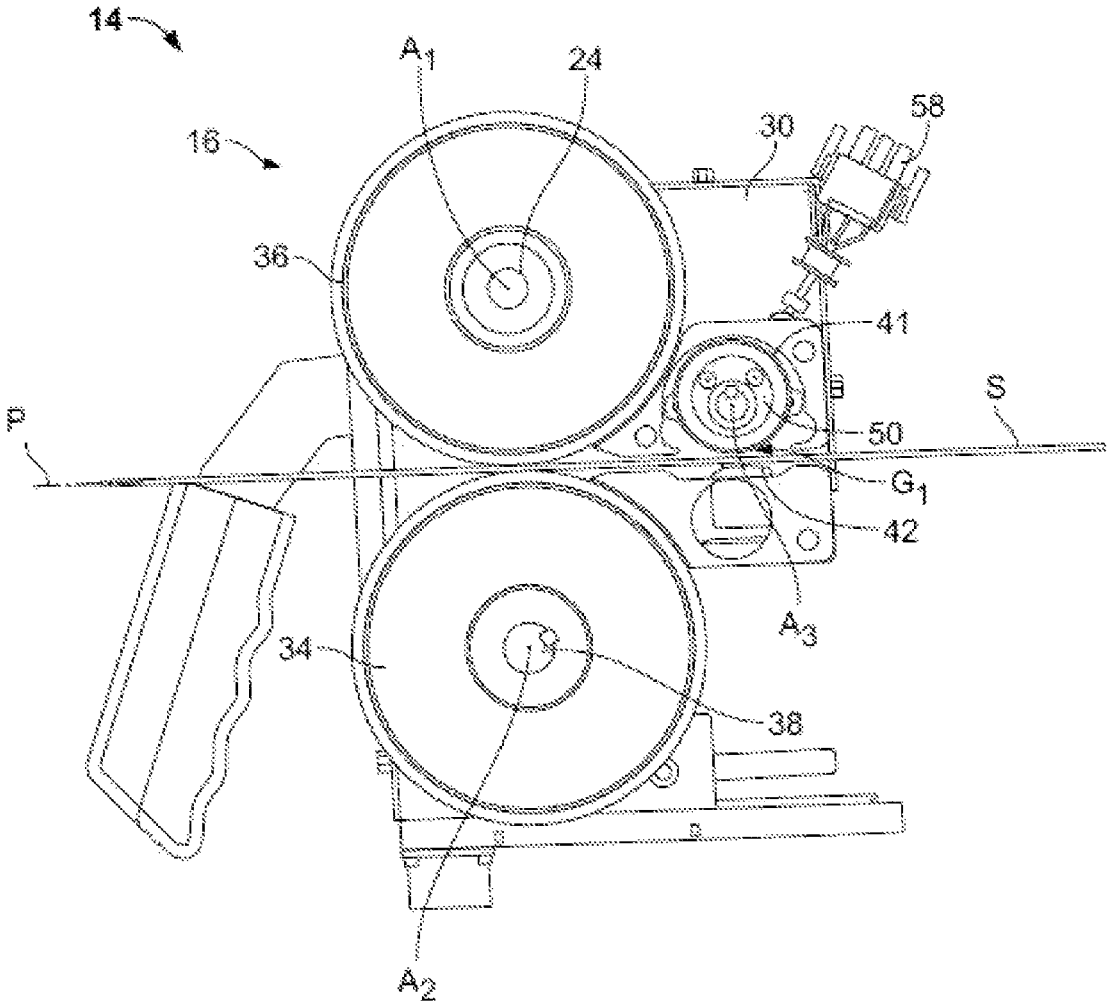
FIG. 5 is a cross-sectional view of the modular strap feeder assembly of FIG. 3 in a strap feed position, taken generally along lines 5-5 of FIG. 3.

Further, the pinch wheel 36 of each feed head 16 is operably connected to the rocker arm 40 at a pivot or pin 24, which extends through an opening 32 defined in the frame 22, as seen in FIGS. 6 and 9, for example. The pivot or pin 24 also defines the axis of rotation $A_1$. The rocker arm 40 has an engagement surface 42 and a pivot 44, which defines a rotational axis $A_4$ of the rocker arm, as seen in FIG. 7, for example. The rocker arm 40 is also connected to the frame 30 at the pivot 44. The rocker arm 40 rotates about the pivot 44 in a clockwise and counterclockwise direction, as indicated generally by arrow 48 of FIG. 7, for example. Rotation of the rocker arm 40 causes the pinch wheel 36 coupled thereto by the pin 24 to move generally up and down with respect to the drive wheel 34, as indicated generally by arrow 46 of FIG. 9, for example. More particularly, the rotation of the rocker arm 40 moves the pinch wheel 36 between a first strap feed or operational feed position, as illustrated in FIGS. 5 and 6, for example, and a second strap grip or cut-and-seal position, as illustrated in FIGS. 8 and 9, for example. The rocker arm 40 is biased in the first strap feed or operational feed position by a spring 68 and by a handle 60, as shown in FIG. 7, for example.

Figure 11:
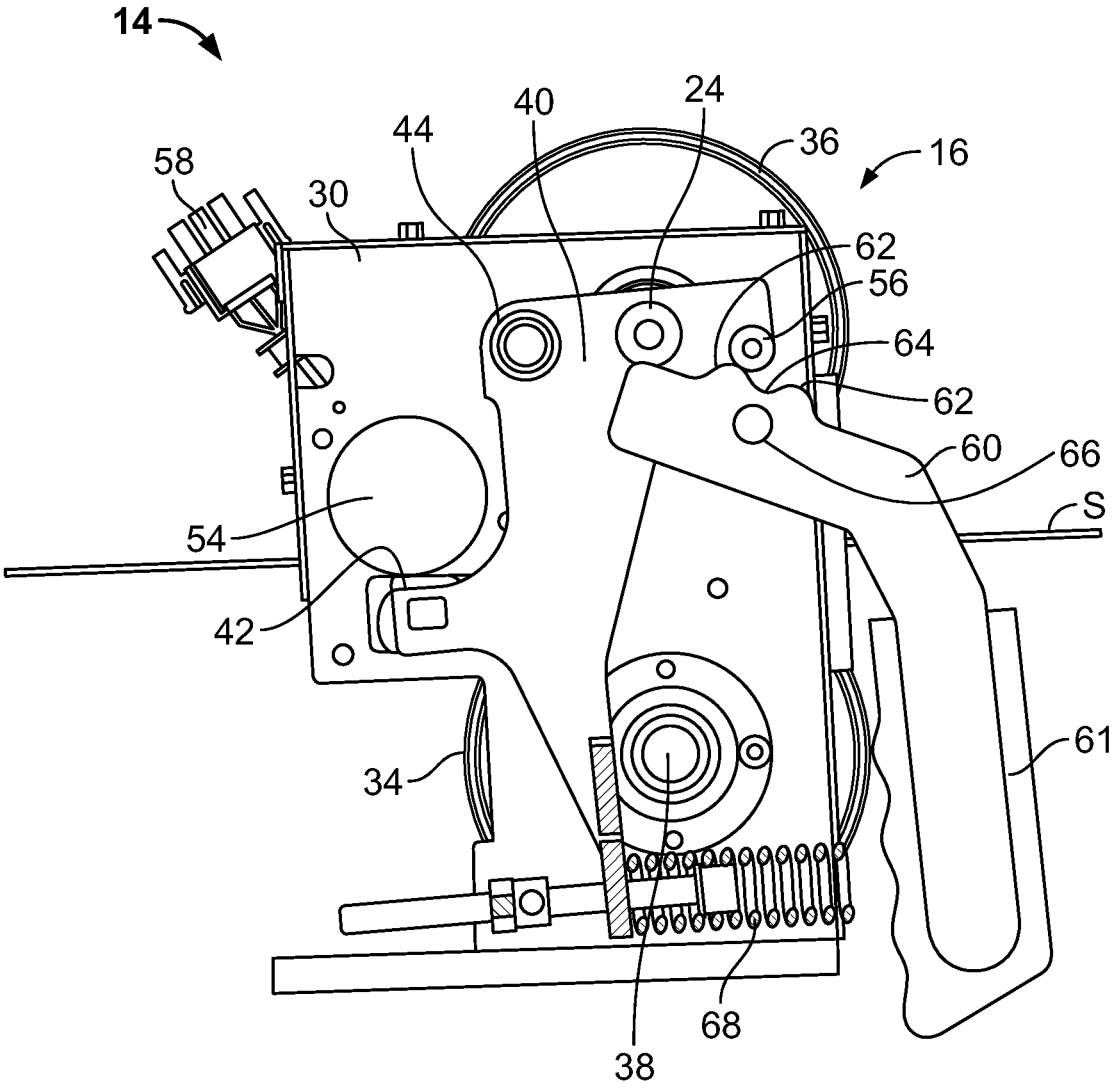
FIG. 11 is a cross-sectional view of the modular strap feeder assembly of FIG. 3 with a handle in a push-to-load position, taken generally along lines 11-11 in FIG. 3.
Figure 12:
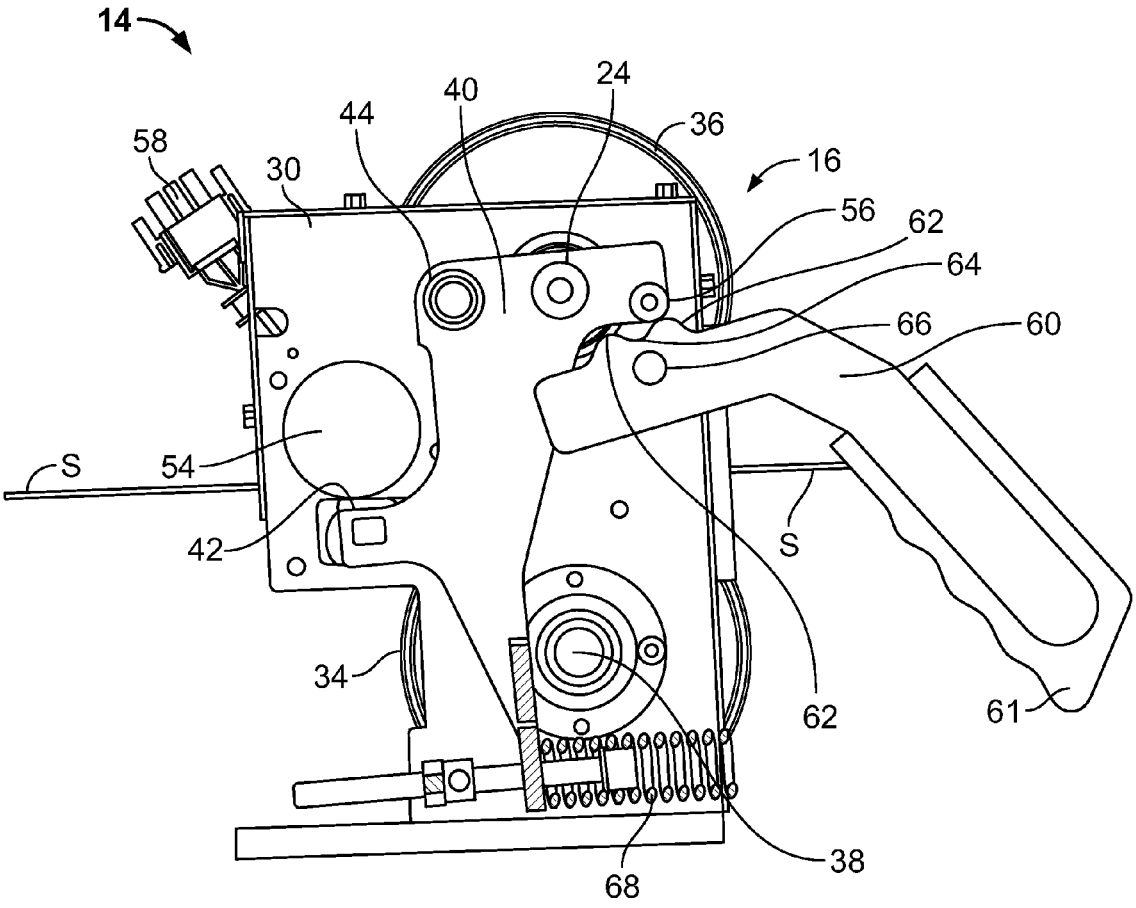
FIG. 12 is another cross-sectional view similar to FIG. 11 of the modular strap feeder assembly of FIG. 3 with a handle in a pull-to-load position.

The handle 60 is pivotally mounted to the frame 22 by a pivot or pin 66 and is in physical communication with the rocker arm 40, as seen, for example, in FIGS. 11 and 12. Referring still to FIGS. 11 and 12, the handle 60 includes a grip 61 and a wavy or undulating surface that includes one or more peaks 62 that define a valley 64 therebetween. The peak(s) 62 and the valley 64 are configured to engage and interact with a roller 56 disposed on the rocker arm 40, as will be described in more detail hereinafter.

Figure 10:
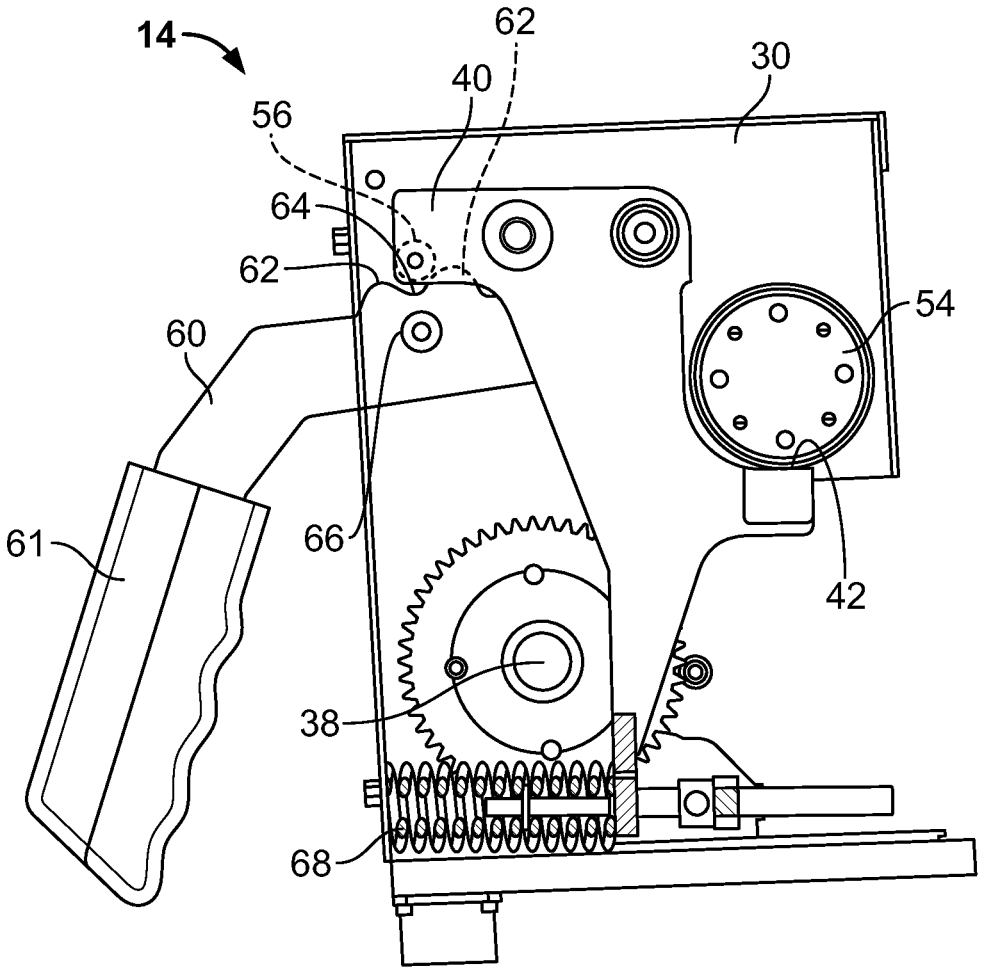
FIG. 10 is a cross-sectional view similar to FIG. 7 of the modular strap feeder assembly in a strap grip or cut-and-seal position.

The eccentric cam 50 has an axis of rotation $A_3$ and is rotated by a cam motor 54, as seen in FIGS. 7 and 10, for example, to move toward and away from an engagement surface 42 of the rocker arm 40. A gap $G_1$, as seen in FIGS. 5 and 6, for example, is defined between the eccentric cam 50 and the engagement surface 42. Further, the eccentric cam 50 may have teeth or an abrasive surface 41 on an outer periphery thereof. When the cam motor 54 drives the eccentric cam 50 toward the engagement surface 42, the gap $G_1$ is decreased and the strap S is engaged or held between the cam and the engagement surface, as illustrated in FIG. 8, for example. When the cam motor 54 drives the eccentric cam 50 away from the engagement surface 42, the gap $G_1$ is increased and the strap S is not longer engaged or held between the cam and engagement surface, as illustrated in FIG. 5, for example.

In the present example, a proximity sensor 58 is positioned in communication with the eccentric cam 50 and provides positional/status information or feedback of the cam 50 to a controller (not shown) of the strapping machine 10. The controller controls the cam motor 54 to drive the cam 50 toward and away from the engagement surface 42 to clamp and unclamp the strap S therebetween in accordance with data from the proximity sensor 58, for example.

In one example of the strapping machine 10 in operation, the load L to be bundled or strapped is introduced into the strapping machine 10. In the case of layers of compressible material, such as cotton or textile materials, the load L is stacked generally from the lower portion 28 of the chute 20 upward along the side portions 24 of the chute. Once a desired number of layers have been stacked or a desired height of the load L reached, the compression plate or platen 22 can be actuated to move down and compress the load.

Thereafter, a strapping cycle can be performed, which typically includes at least two phases. In one example, the strapping cycle includes an operational strap feeding phase and an operational cut-and-seal phase. During the operational strap feeding phase, the strap S is fed from a strap supply P to the feed head 16. In the present example, the drive wheel 34 and the pinch wheel 36 are spring-biased by the spring 68 in the operational feed position, as shown in FIGS. 5-7, for example, in which the wheels 34, 36 are engaged to pinch or clamp the strap S therebetween. In the operational feed position, the eccentric cam 50 is disposed away from the engagement surface 42 to increase the gap $G_1$ so that the strap S is not pinched or clamped between the cam and the engagement surface. Further, in the operational feed position, the roller 56 of the rocker arm 40 is disposed in the valley 64 of the handle 60, as shown generally in phantom lines in FIG. 7.

In the operational feed position, the drive motor 70 is actuated to rotate the drive wheel 34 and feed the strap S through the chute 20. More particularly, the strap S is fed from the feed head 16 through the sealing head 18, over and around the various portions 24-28 of the chute 20, and back to the sealing head. At the sealing head 18, the strap S is, during the cut-and-seal phase of operation, sealed onto itself and is cut from the feed or supply side to create a loop around the load L.

After the strap S is fed through the chute 20, the strapping cycle transitions between the strap feeding phase and the cut-and-seal phase. In one example, the transition between phases includes controlling the cam motor 54 to actuate the cam 50 to rotate and move toward the engagement surface 42 of the rocker arm 40, thus, decreasing the gap $G_1$ and pinching or clamping the strap S therebetween.

In the present example, the transition also simultaneously disengages the pinch wheel 36 from the drive wheel 34 to release the strap S, which results in the feed head 16 assuming a strap grip or cut-and-seal position, as shown in FIGS. 8-10, for example. More particularly, the force of the cam 50 against the engagement surface 42 of the rocker arm 40 causes the rocker arm to pivot or rotate clockwise around the axis of rotation $A_4$. Such rotation of the rocker arm 40 causes the roller 56 thereof to move generally upwardly from the valley 64 of the handle 60 to a peak 62 on the handle 60, which, in turn, moves the pinch wheel 36 generally upwardly, as seen more particularly in FIG. 9. The upward movement of the pinch wheel 36 increases the gap $G_2$ and disengages the pinch wheel from the drive wheel 34 to release the strap S.

With the strap S gripped between the cam 50 and the engagement surface 42, the strap S can be cut and the sealing head 18 actuated to release the strap S. In addition, the upper compression platen 22 may be released to allow the load L to expand against the retention of the strap S. The portions 24-28 of the chute 20 can then be opened and the strapped load L removed from the machine 10.

After the cut-and-seal phase, the cam 50 can be further actuated by the motor 54 to return the feed head 16 to the strap feed position in preparation for the strap feeding phase of the strapping cycle where the strap S is fed through the chute 20 and the strapping cycle may be repeated, as described above.

In addition, an operator may push the handle (e.g., FIG. 11) or pull the handle (e.g., FIG. 12) so that the engagement surface 42 engages the roller 56, which, in turn, moves the pinch wheel 36 generally upwardly, as describe above. Utilizing the handle 60 to move the pinch wheel 36 away from the drive wheel 34 differs from the motor 54 and cam 50 actuated transition to the cut-and-seal position because the cam 50 does not need to be moved towards the engagement surface 42 to rotate the rocker arm 40. Thus, an operator can manually move the rocker arm 40 and the pinch wheel 36 to load the strap S between the drive wheel 34 and the pinch wheel and between the cam 50 and the engagement surface 42.

It will be appreciated that although the present feed assembly 14 is shown and described as part of a strapping machine 10 for a compressible load L, the feed assembly can be used with most any other type of strapping machine.

The advantages to the present strap feed assembly 14 will be appreciated by those skilled in the art. The strap feed assembly 14 reduces wear and tear on the drive and pinch wheels 34, 36 by using the cam 50 and the engagement surface 42 to grip the strap S during a portion of the strapping cycle. By separating the strap feeding operation from the cut-and-seal operation, and relying on a mechanism apart from the drive and pinch wheels 34, 36 to grasp the strap S during the cut-and-seal phase, the forces acting on the drive and pinch wheels 34, 36 are reduced, thus prolonging the useful life of the strap feed assembly 14.

Further, the strap feed assembly 14 facilitates isolation and servicing of individual units without disturbing remaining units in the strapping machine 10. For example, if one feed assembly 14*a* needs to be removed and serviced, the remaining feed assemblies 14*b*-14*f* can be transitioned to the cut-and-seal phase with the respective straps Sb-Sf gripped between each respective cam 50 and engagement surface 42. Thereafter, the feed assembly 14*a* can be decoupled from the drive shaft 38 of the motor 70 and removed from the strapping machine 10 for servicing without disturbing the remaining units 14*b*-14*f*, which may remain in the cut-and-seal phase.

In another example, if a feed assembly 14*a* has misfed the strap Sa, the remaining feed assemblies 14*b*-14*f* can be transitioned to the cut-and-seal phase, as described above, while the feed assembly 14*a* remains in the strap feeding phase with the strap Sa pinched or clamped between the drive wheel 34 and the pinch wheel 36. Thereafter, the motor 70 can actuate the drive shaft 38 to rotate the drive wheel 34 and feed the strap Sa through the chute 20, while the properly fed straps Sb-Sf remain pinched between each cam 50 and engagement surface 42 of the feed assemblies 14*b*-14*f*.

In yet another example, the strap feed assemblies 14 are utilized in a strapping machine 10 with a strap seal rotating mechanism, as described generally above, without requiring additional mechanical or electromechanical clutches or other stabilizing mechanism around the pinch and drive wheels 34, 36. In the present example, each strap feed assembly 14 can be transitioned to the cut-and-seal phase so that the strap S is not pinched or clamped between the drive wheel 34 and the pinch wheel 36. Consequently, the motor 70 can actuate the drive shaft 38 to rotate the strap seal without feeding excess strap through the machine.

Numerous modifications to the present disclosure will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

The invention claimed is:

1. A modular strap feeder assembly for use with a strapping machine of the type for feeding a strapping material around a load, tensioning the strapping material, and sealing the strapping material onto itself in a loop around the load, the modular strap feeder assembly comprising:

a frame;

a drive wheel mounted to the frame and having a first axis of rotation, wherein the drive wheel is configured to be connected to a first drive for rotating the drive wheel;

a pinch wheel having a second axis of rotation parallel to and spaced from the first axis of rotation of the drive wheel;

a rocker arm mounted to the frame in communication with the pinch wheel and including an engagement surface and a pivot axis parallel to both the first and second axes of rotation;

an eccentric cam coupled to the frame; and a cam motor coupled to the eccentric cam, wherein the eccentric cam, driven by the cam motor, is rotated between a first position where the eccentric cam is disengaged from the engagement surface of the rocker arm to allow movement of the pinch wheel into engagement with the drive wheel and a second position where the eccentric cam is engaged with the engagement surface to move the pinch wheel out of engagement with the drive wheel, and wherein a travel path of the strapping material is defined between the drive wheel and the pinch wheel and between the rocker arm and the eccentric cam.

2. A modular strap feeder assembly for use with a strapping machine of the type for feeding a strapping material around a load, tensioning the strapping material, and sealing the strapping material onto itself in a loop around the load, the modular strap feeder assembly comprising:

a frame;

a drive wheel mounted to the frame and having a first axis of rotation, wherein the drive wheel is configured to be connected to a first drive for rotating the drive wheel;

a pinch wheel having a second axis of rotation parallel to and spaced from the first axis of rotation of the drive wheel;

a rocker arm mounted to the frame in communication with the pinch wheel and including an engagement surface and a pivot axis parallel to both the first and second axes of rotation;

an eccentric cam coupled to the frame; and a cam motor coupled to the eccentric cam, wherein the eccentric cam, driven by the cam motor, is engageable with the engagement surface of the rocker arm to move the pinch wheel into and out of engagement with the drive wheel, and wherein the rocker arm includes one or more rollers, and the strap feeder assembly further includes a handle with a surface peak, wherein the handle is coupled to the rocker arm such that movement of the handle causes the one or more rollers to engage the surface peak of the handle to move the pinch wheel out of engagement with the drive wheel.

3. The strap feeder assembly of claim 1, wherein movement of the rocker arm to the second position moves the pinch wheel, mounted to the rocker arm, away from the strapping material, forming a gap between the pinch wheel and the drive wheel in a cut-and-seal phase of the strap feeder assembly.

4. The strap feeder assembly of claim 3, wherein the strapping material is secured between the eccentric cam and the engagement surface of the rocker arm in the cut-and-seal phase.

5. The strap feeder assembly of claim 1, wherein the strapping material is clamped between the pinch wheel and the drive wheel in a strap feeding phase of the strap feeder assembly.

6. The strap feeder assembly of claim 5, wherein the eccentric cam, in the first position, is disposed away from the engagement surface of the rocker arm so that the strapping material is not clamped therebetween in the strap feeding phase.

7. The strap feeder assembly of claim 5, further comprising a biasing element that biases the strap feeder assembly in the strap feeding phase.

8. The strap feeder assembly of claim 1, wherein the pinch wheel is mounted to the rocker arm by a pin that extends through an opening defined in the frame.

9. The strap feeder assembly of claim 1, further including a proximity sensor coupled to the frame.

10. The strap feeder assembly of claim 9, wherein the proximity sensor determines and conveys status information regarding the eccentric cam to control a position thereof.

11. A strapping machine of the type for feeding a strapping material around a load, tensioning the strapping material, and sealing the strapping material onto itself in a loop around the load, the strapping machine comprising:

a strap dispenser;

a strap chute;

a strap feeding assembly coupled to feed strapping material from the strap dispenser through the strap chute, the strap feeding assembly comprising:

a frame;

a drive wheel mounted to the frame and having a first axis of rotation, wherein the drive wheel is configured to be connected to a first drive for rotating the drive wheel;

a pinch wheel having a second axis of rotation parallel to and spaced from the first axis of rotation of the drive wheel;

a rocker arm mounted to the frame in communication with the pinch wheel and including an engagement surface and a pivot axis parallel to both the first and second axes of rotation;

an eccentric cam coupled to the frame; and a cam motor coupled to the eccentric cam, wherein the eccentric cam, driven by the cam motor, is selectively engageable with the engagement surface of the rocker arm to move the pinch wheel into and out of engagement with the drive wheel, and the strap feeding assembly is configured to receive the strapping material between the eccentric cam and the engagement surface of the rocker arm.

12. The strapping machine of claim 11, wherein the rocker arm includes one or more rollers, and the strap feed assembly further includes a handle with a surface peak, wherein the handle is coupled to the rocker arm such that movement of the handle causes the one or more rollers to engage the surface peak of the handle to move the pinch wheel out of engagement with the drive wheel.

13. The strapping machine of claim 11, wherein movement of the rocker arm moves the pinch wheel, mounted to the rocker arm, away from the strapping material, forming a gap between the pinch wheel and the drive wheel in a cut-and-seal phase of the strap feeder assembly.

14. The strapping machine of claim 13, wherein the strapping material is secured between the eccentric cam and the engagement surface of the rocker arm in the cut-and-seal phase.

15. The strapping machine of claim 11, wherein the strapping material is clamped between the pinch wheel and the drive wheel in a strap feeding phase of the strap feeder assembly.

16. The strapping machine of claim 15, wherein the eccentric cam is disposed away from the engagement surface of the rocker arm so that the strapping material is not clamped therebetween in the strap feeding phase.

17. The strapping machine of claim 15, further comprising a biasing element that biases the strap feeder assembly in the strap feeding phase.

18. The strapping machine of claim 11, wherein the pinch wheel is mounted to the rocker arm by a pin that extends through an opening defined in the frame.

19. The strapping machine of claim 11, further including a proximity sensor coupled to the frame.

20. The strapping machine of claim 19, wherein the proximity sensor determines and conveys status information regarding the eccentric cam to control a position thereof.

* * * * *